US007878773B2

(12) United States Patent
Zumbrum et al.

(10) Patent No.: US 7,878,773 B2
(45) Date of Patent: Feb. 1, 2011

(54) DYNAMICALLY TENSIONED PERISTALTIC TUBING PUMP

(75) Inventors: Michael Allen Zumbrum, Rising Sun, MD (US); George H. Coates, III, Chesapeake City, MD (US)

(73) Assignee: Maztech, Inc., Elkton, MD (US)

( * ) Notice: Subject to any disclaimer, the term of this patent is extended or adjusted under 35 U.S.C. 154(b) by 136 days.

(21) Appl. No.: 11/246,398

(22) Filed: Oct. 8, 2005

(65) Prior Publication Data

US 2006/0083644 A1 Apr. 20, 2006

Related U.S. Application Data

(60) Provisional application No. 60/617,050, filed on Oct. 12, 2004.

(51) Int. Cl.
*F04B 43/12* (2006.01)

(52) U.S. Cl. ..... 417/477.11; 417/363; 417/476; 417/477.1

(58) Field of Classification Search ..... 417/474, 417/476, 477.1–477.14, 475, 477.3, 477.7, 417/477.8, 477.9, 477.2, 363; 285/235; 251/5–10
See application file for complete search history.

(56) References Cited

U.S. PATENT DOCUMENTS 2,002,862 A * 5/1935 Moran ..... 417/476
2,885,967 A * 5/1959 Vogel et al. ..... 417/477.6
3,140,666 A * 7/1964 Currie ..... 417/477.11
3,172,367 A * 3/1965 Kling ..... 417/475
3,329,390 A * 7/1967 Hulsey ..... 251/4
3,433,170 A * 3/1969 Malbec ..... 417/412
3,491,983 A * 1/1970 Van Damme et al. ..... 251/5
RE27,376 E * 5/1972 Pickup ..... 417/477.12
3,816,035 A * 6/1974 Malbec ..... 417/477.6
3,875,970 A * 4/1975 Fitter ..... 138/110
4,025,241 A * 5/1977 Clemens ..... 417/477.11
4,181,476 A * 1/1980 Malbec ..... 417/477.3
4,218,197 A * 8/1980 Meyer et al. ..... 417/442
4,229,299 A * 10/1980 Savitz et al. ..... 210/85
4,498,691 A 2/1985 Cooke
4,540,350 A * 9/1985 Streicher ..... 417/475
4,932,687 A * 6/1990 Anderson et al. ..... 285/41
4,976,590 A * 12/1990 Baldwin ..... 417/53
4,976,593 A * 12/1990 Miyamoto ..... 417/476

(Continued)

*Primary Examiner*—Devon C Kramer
*Assistant Examiner*—Leonard J. Weinstein
(74) *Attorney, Agent, or Firm*—Womble Carlyle Sandridge & Rice, PLLC; Jacob S. Wharton

(57) ABSTRACT

An improved peristaltic pump whereby the elastomeric tubing communicates with the peristaltic pump in a way that allows for axial movement of the tubing thereby extending the flex life of the pump tubing. A tubing element is fitted with a flange that allows tension to be applied to the tubing in a way that changes depending upon the location of the rotor at any given time. The tension can be applied via an elastic material located between the flange and the housing or between the housing and a device that communicates with the flange. The dynamic tension reduces the amount of stress on the tubing material when the rollers first engage the tubing on the suction side of the pump and when they depart the tubing on the discharge side of the pump. The invention is particularly useful for materials that have limited axial flexibility and for those with very large axial flexibility.

13 Claims, 4 Drawing Sheets

U.S. PATENT DOCUMENTS 5,281,112 A * 1/1994 Montoya et al. ..... 417/477.12
5,356,267 A 10/1994 Fulmer
5,388,972 A 2/1995 Calhoun et al.
5,482,447 A * 1/1996 Sunden et al. ..... 417/477.12
5,486,099 A * 1/1996 Montoya ..... 417/477.13
5,564,676 A * 10/1996 Goloff et al. ..... 251/129.15
5,749,609 A * 5/1998 Steele ..... 285/226
5,759,017 A * 6/1998 Patton et al. ..... 417/477.9
5,971,726 A * 10/1999 Yoshida et al. ..... 417/477.1
6,361,016 B1 * 3/2002 Schulz ..... 251/7
6,406,267 B1 * 6/2002 Mondiere ..... 417/53
6,468,059 B2 * 10/2002 Haser et al. ..... 417/477.1
6,494,692 B1 12/2002 Green
6,551,080 B2 * 4/2003 Andersen et al. ..... 417/477.11
7,118,203 B2 * 10/2006 Davis et al. ..... 347/85
2005/0013193 A1 * 1/2005 Murphy et al. ..... 366/107

* cited by examiner

DYNAMICALLY TENSIONED PERISTALTIC TUBING PUMP

This application claims benefit of provisional application No. 60/617,050 filed Oct. 12, 2004.

FIELD OF THE INVENTION

The present invention is directed to a dynamically tensioned peristaltic pump.

BACKGROUND OF THE INVENTION

Peristaltic pumps are used in numerous applications that require low shear pumping, portability, ability to run dry, ease of cleaning, accurate dosing, etc. These applications can be found in industries ranging from pharmaceutical manufacturing to food processing to water treatment.

The basic principle of peristaltic pumping involves the rotation of a central rotor containing either rollers or fixed shoes against a resilient elastomeric tube surrounding the rotor that is compliant enough to allow for complete collapse from the rotating rollers, and yet elastic enough to recover to a circular cross-section (referred to as restitution) once the rollers pass, thus enabling the next segment of tubing to fill with the process fluid and maintain flow.

Although peristaltic pumps have many advantages, they do suffer from some drawbacks. In particular, if tubing is not properly installed in the pumphead, the tubing can be damaged by the rotor and cause premature failure. This is particularly true when the tubing is twisted upon installation or the tubing elongates during operation within a fixed cavity pumphead.

Another disadvantage of peristaltic pumping is the relatively short flex life of the tubing materials. The flex life often dictates how frequently the tubing needs to be replaced and thus affects the maintenance costs. Many devices have been developed to extend the life of pump tubing. In particular, manufacturers have used spring loaded rollers and spring loaded tracks to reduce the load on the tubing. However, in all prior art, the tubing is held rigidly in the pump housing. The rigid anchoring of the tubing requires the tubing to stretch significantly upon compression and restitution in the pumphead.

Green (U.S. Pat. No. 6,494,692 B1) discloses a peristaltic pump with tubing elements that are easily installed and removed. The elements are equipped with non-circular plastic flanges that are positioned in complimentary recesses in the pump head to prevent lengthwise movement of each end of the tube relative to the pumphead housing and inhibit twisting of the tube. This invention, however, overlooks the fact that many tubing materials grow in length upon flexure, and become entangled in the pumphead, thus leading to premature failure. It also requires very tight tolerances on the element length to avoid diminishing the intended flex life.

Calhoun (U.S. Pat. No. 5,388,972) also discloses a peristaltic pump with elements to precisely control the length of tubing operated upon by the pump. Recesses are provided on either side of a tube element having different sizes and/or shape to control the orientation of the tubing.

Fulmer (U.S. Pat. No. 5,356,267) discloses a removable cartridge that includes a length of tubing and a collapsing device such as a rotor. He discloses the use of flanges that grip the tubing to communicate with slots in the housing, thus securing the tubing in place. This invention allows for rapid replacement of tubing elements as well.

Fittings for tubing are well known in the industry. Cooke (U.S. Pat. No. 4,498,691) describes hydraulically crimped fittings that can be used to securely hold peristaltic pump tubing for the instant invention. Flanges can also be injection molded around pump tubing elements at convenient locations along the tubing axis to secure the tubing in the inventive pumphead. Other means of locating the tubing in the peristaltic pump head can be used as well.

A pump in accordance with the present invention will enable engagement of fitted tubing elements with a peristaltic pumphead. The inventive pump will accommodate the viscoelastic properties of tubing materials that either resist elongation or result in excessive elongation upon pumping.

SUMMARY OF THE INVENTION

In summary, the present invention provides a peristaltic pump that can apply tension to tubing inside the pumphead during the pumping operation via the use of compliant materials and flanged tubing that communicates with the pumphead. The flanges can act upon a compliant material, such as a metallic spring or a soft elastomer in contact with the tubing, to transfer the longitudinal stress from the tubing into the compliant material. The compliant material communicates with a corresponding recess in the pumphead housing to locate the tubing in the pumphead. The compliant material must enable sufficient axial movement of the tubing to reduce the adverse effects of compression and restitution of the tubing upon passage of rollers in the rotor assembly. The motion of the tubing need not be restricted to movement in one axis, so that longitudinal and axial movement are defined as movement in any direction.

Another objective of the invention is to provide a compliant material located within a receiving piece attached to the pumphead housing to accept the flanged tubing. This embodiment enables the compliant material to be a permanent part of the pumphead in order to reduce the cost of operation.

Preferably, the receiving piece is attached to the pumphead housing with shoulder bolts and made compliant via stainless steel springs positioned between the receiving piece and the pumphead. The receiving piece should enable sufficient axial movement of the tubing to reduce the adverse effects of compressing the tubing with the rotor assembly. Preferrably, the springs enable movement up to 10 mm in distance on both the suction and discharge sides of the pump.

A final objective of the invention is to provide a method of peristaltic pumping whereby the elastomeric tubing communicates with the peristaltic pump in a way that allows for axial movement of the tubing thereby extending the flex life of the tubing.

Figure 1:
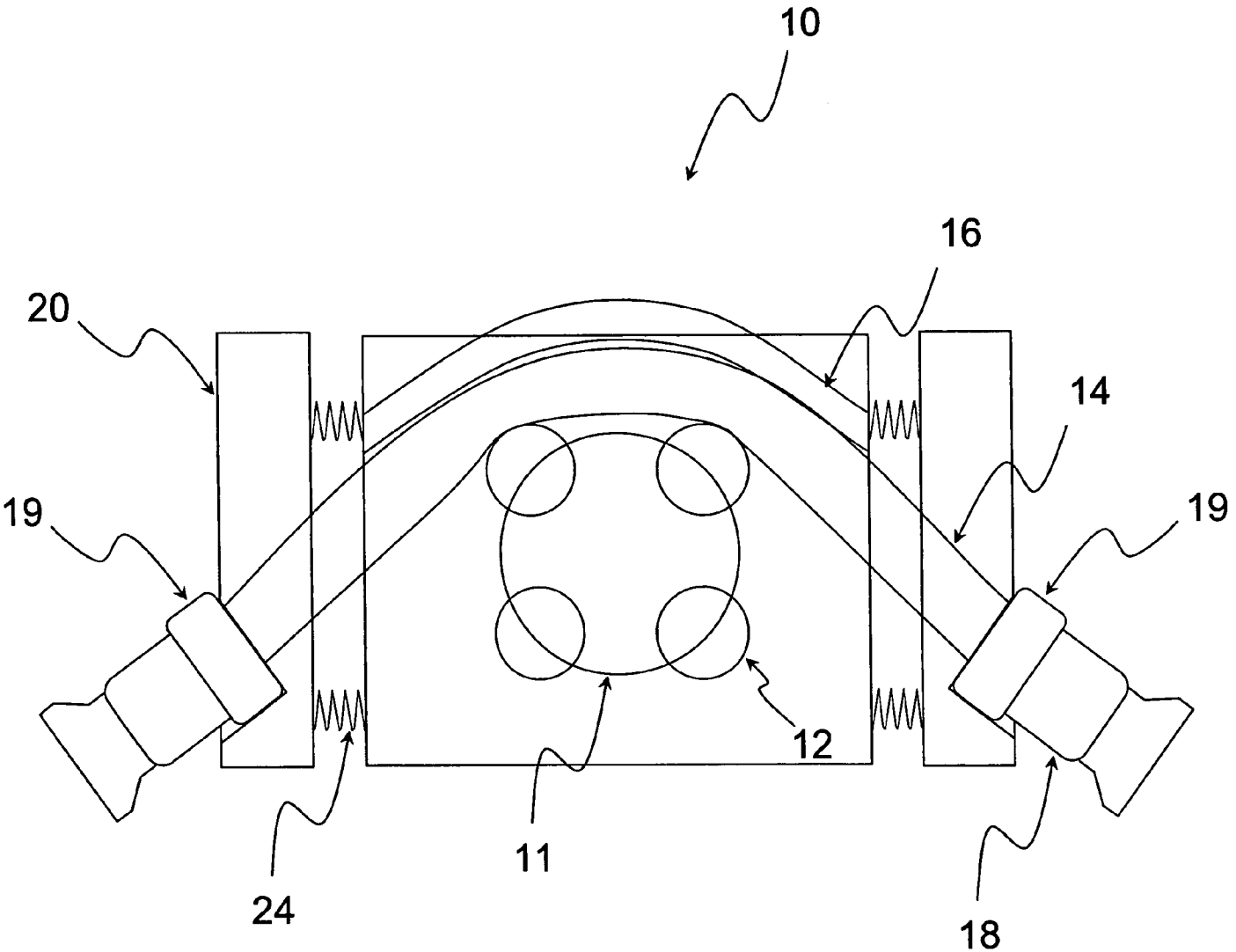
FIG. 1. Diagram of a rotary peristaltic tubing pump with spring loaded receiving blocks.

FGI. 4. Diagram of pinch valve with spring loaded element.

DETAILED DESCRIPTION OF THE INVENTION

The present invention relates to an improved peristaltic pumphead and to methods of peristaltic pumping. The improved pumphead 10 shown in FIG. 1 comprises a rotor 11 which contains a plurality of rollers 12 necessary to squeeze the tubing 14 against the track 16. The tube 14 can be fitted with crimped fittings 18 and locating collars 19 for mounting into mounting blocks or receiving plates 20 which are attached to the pumphead housing with shoulder bolts passing through springs 24 that enable the receiving plates to ride on the shoulder bolts during operation.

Figure 2:
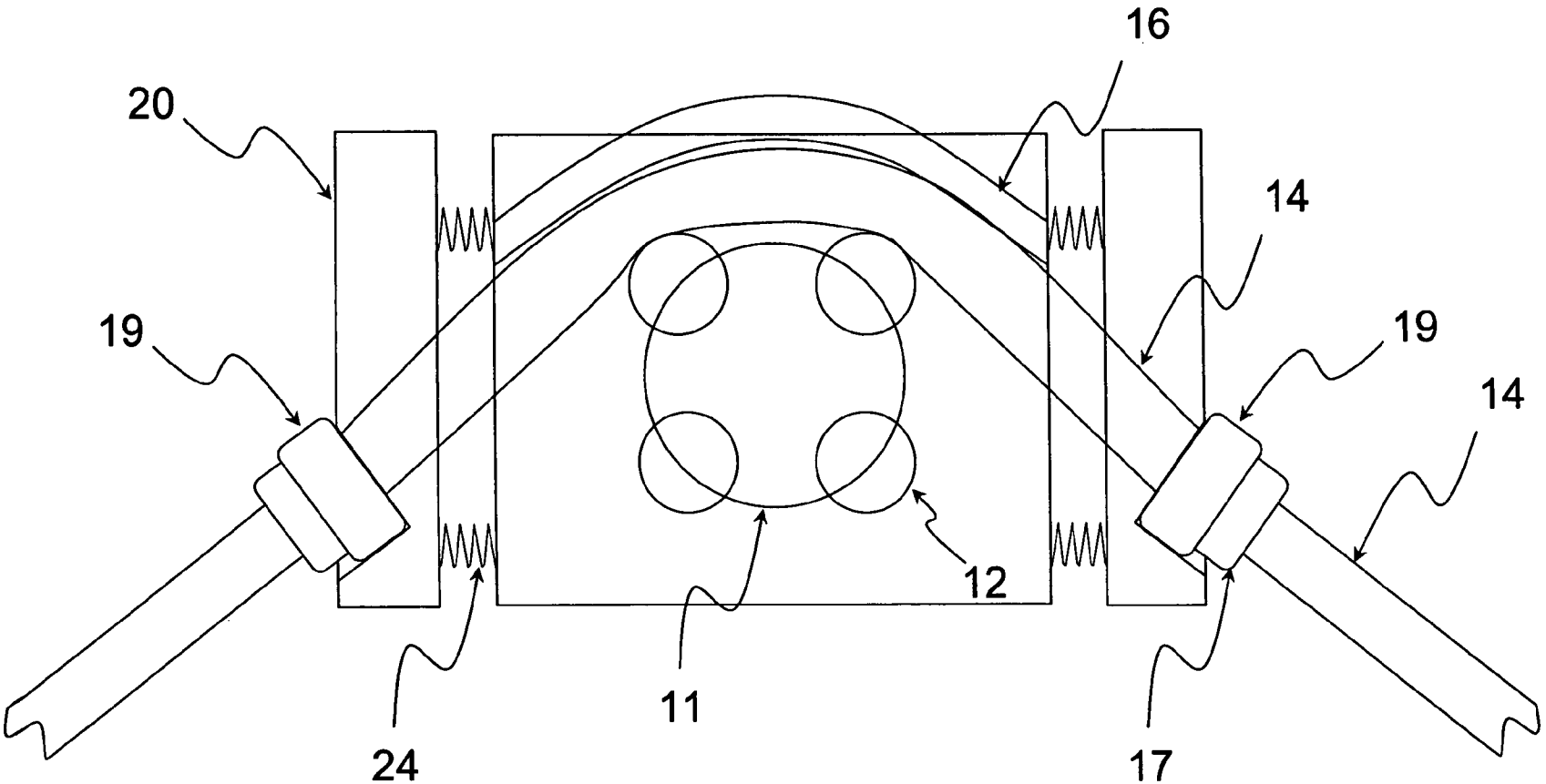
FIG. 2. Diagram of continuous tubing in inventive pumphead.

FIG. 2 shows the use of continuous tubing in the inventive pumphead 10. In particular, coils of tubing can be fitted with locating collars 19 at any point along the tubing axis, as long as the length between two locating collars is sufficient to locate the tubing in the pumphead under tension. The locating collars can be fabricated from metals, composites, or molded onto the tube with either thermoset or thermoplastic materials. Common thermoplastic materials include polypropylene, polyethylene, polycarbonate, polyimide, polyether ether ketone, perfluoroalkoxy, fluorinated ethylene propylene and polystyrene. The use of soft materials as locating collars can also serve to allow for axial motion of the tubing inside the pumphead.

Locating collars 19 can also be machined and mounted onto the tubing with retaining rings 17. One such fastener is a metal ring that is crimped around the OD of the tubing in a recess that is ground to a sufficient depth to retain the ring and the locating collar that is positioned onto it. Another type of fastener is an adhesive. Yet another approach is to mold the locating ring directly onto the tubing with thermoplastic or thermoset materials.

Figure 3:
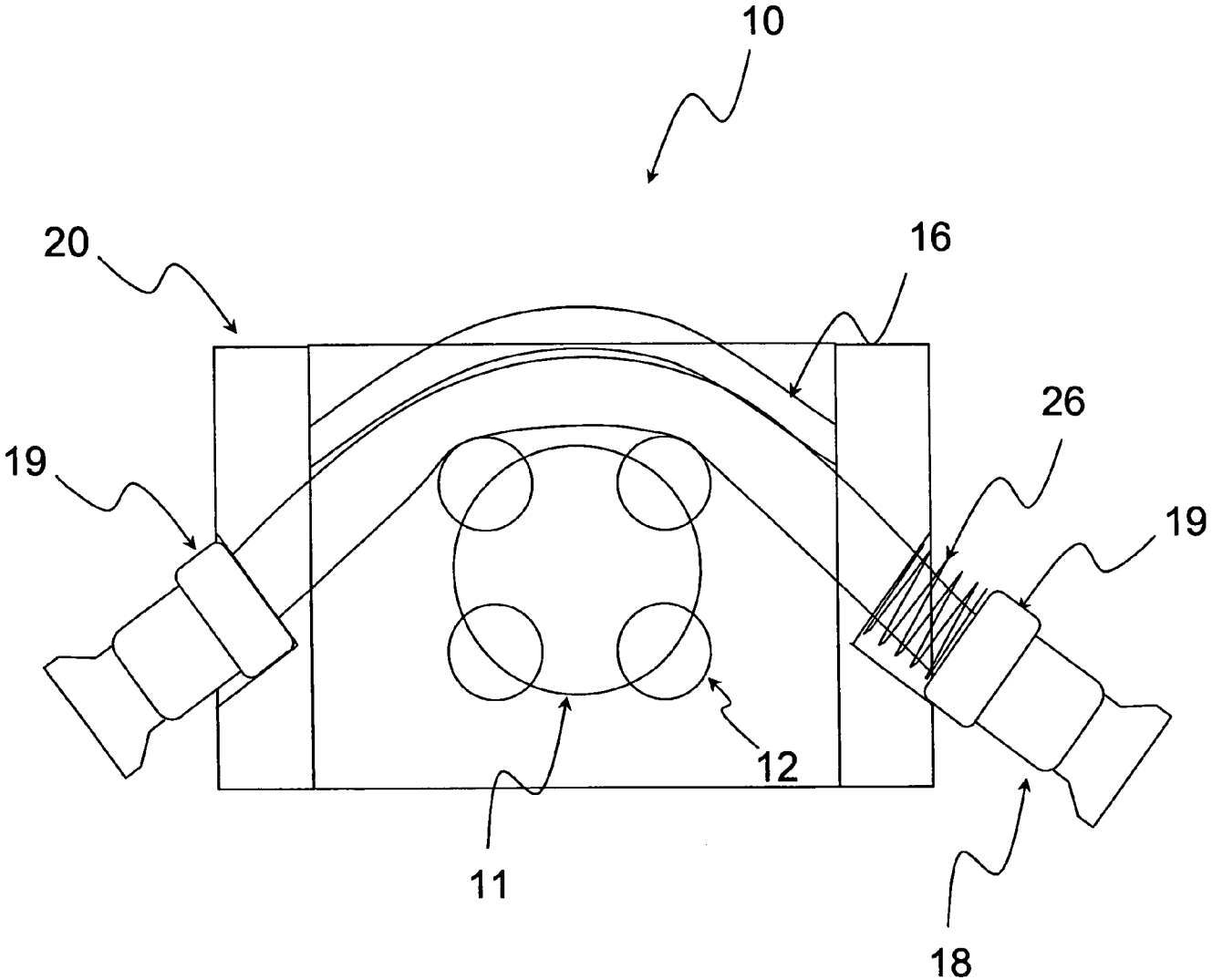
FIG. 3. Diagram of a pumphead with a spring between the mounting block and the restraining collar.

FIG. 3 shows an alternate embodiment wherein the compliant material is a spring 26 adjacent to a locating collar 19 which is positioned against a retaining device. The axial motion is accommodated by the spring in the tubing set. The pump tubing is located in the pumphead using the same receiving pieces 20, but the receiving pieces are attached to the housing to prevent movement of the receiving pieces.

Figure 4:
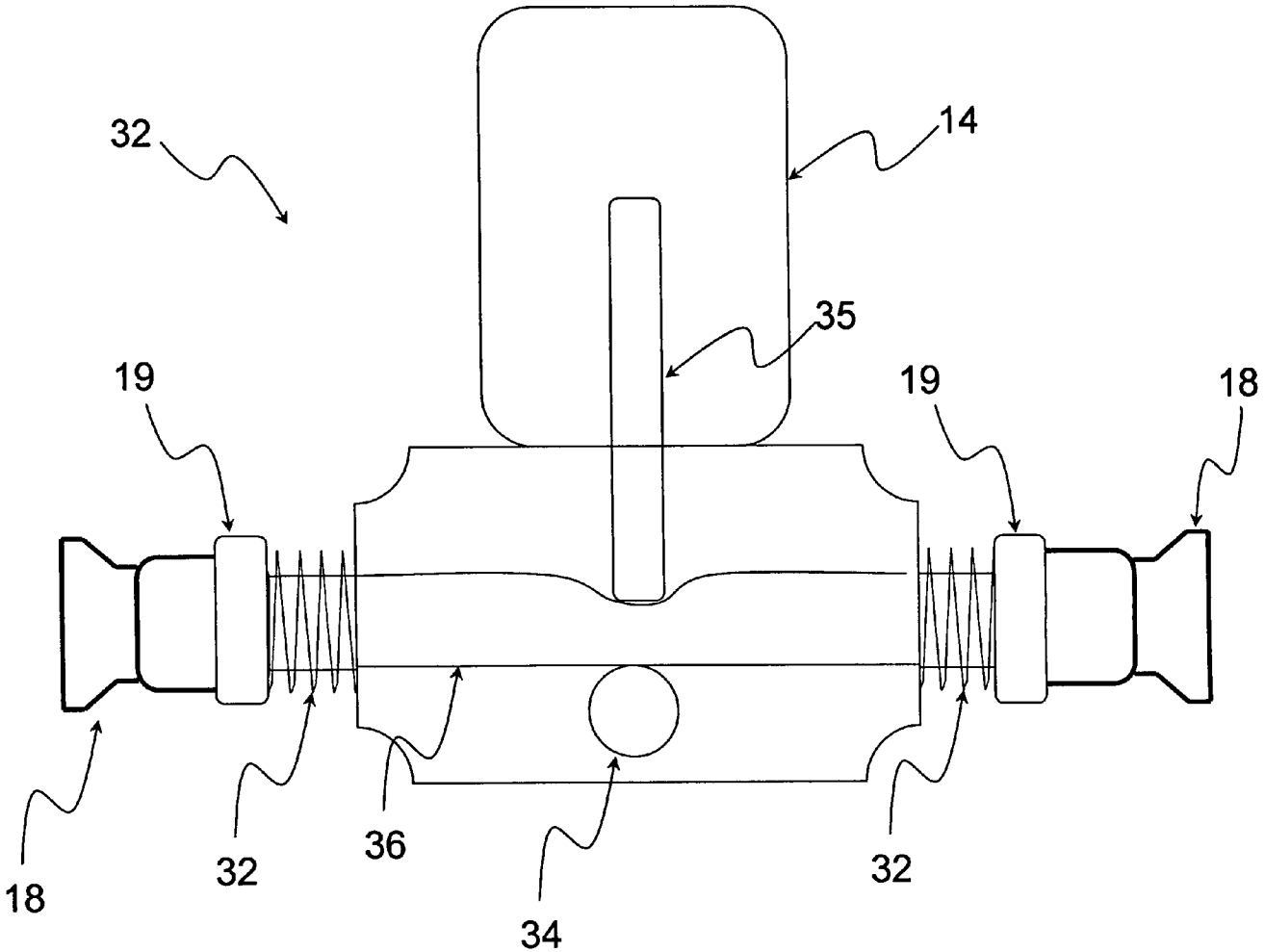

FIG. 4 illustrates the use of dynamically tensioned elements in a pinch valve 32. The axial movement of the tubing occurs due to the compression of the element 36 against a fixed anvil 34 via an actuator 35 in the valve which is used to control the flow of the process fluid. The use of compliant materials such as springs 24 and soft elastomers enables the axial movement of the element upon closure and restitution. The instant invention alleviates the need to use convoluted pinch elements to achieve long life. As a result, the inventive pinch element is self draining which is beneficial for sanitary applications.

It has been surprisingly discovered that the tubing life is significantly extended by allowing for axial movement. The following examples will illustrate the improvements in performance. One skilled in the art will recognize that the invention can assume many different configurations and will not be limited to the examples provided herein.

EXAMPLES

Example 1

A PTFE lined peristaltic pump tube (Part Number SST-16-D), with an inside diameter of 25.4 mm and a wall thickness of 4.8 mm, was obtained from Maztech, Inc. (Rising Sun, MD) and equipped with male cam and groove fittings. The tubing incorporated two cylindrical polyethylene collars machined to accept the outside diameter of the crimped fitting and stepped down to the outside diameter of the tubing so that the collar would apply load to the crimped fitting upon installation into the pumphead, as illustrated in FIG. 1. The polyethylene collars had an outside dimension of 50 mm and communicated with the complimentary recesses in spring loaded blocks mounted on either side of the pumphead. The plastic blocks were made from two 3"×5"×1" pieces of filled nylon with a 2 inch diameter recess at a angle of 35 degrees to accept the tubing element. The blocks were mounted onto a Watson Marlow 704S pump. In particular the blocks were retained on the pumphead via stainless steel shoulder bolts and made compliant with the use of springs positioned between the blocks and the pumphead to enable axial movement of the tube upon pumping. The springs provided a total spring constant of 1.7 Kg/mm. The tubing was loaded into the pumphead and snapped into location in the blocks to result in a 5 mm compression of the springs on either side once mounted into the pumphead.

The Watson Marlow 704 pump was operated at a speed of 360 rpm for 800 hours to accumulate 69 million compressions until failure. The tubing moved approximately 3 mm in the axial direction during each compression as the pump operated. The tubing remained in the center of the pumphead and did not become entangled in the rotor assembly.

Comparative Example A

Another PTFE lined peristaltic pump tube (Part Number SST-16-D), with an inside diameter of 25.4 mm and a wall thickness of 4.8 mm, was mounted in a standard Watson Marlow 704S pump with no modifications to the pumphead. The tubing was secured in place with aluminum dogs on both the suction and discharge sides of the pump so that the tubing could not move in the axial direction. The pump was operated at 250 rpm and within 203 hours (12 million compressions), the tubing had been cut along the axis from the rotor. Failure was due to cutting into the tubing from the rotor and not from fatigue failure of the tubing.

Example 2

A PTFE lined peristaltic pump tube (Part Number SST-16-D) with an inside diameter of 25.4 mm and a wall thickness of 4.8 mm was obtained from Maztech, Inc. (Rising Sun, MD) with male cam and groove fittings. A stainless steel spring with a spring rate of 2 Kg/mm, a wire diameter of 4.8 mm, and an inside diameter of 32 mm, and a length of 75 mm was placed over the tubing and rested upon a split collar attached the crimped fitting on the end nearest the tubing. Another split collar was attached to the ferrule on the other end of the tubing on the crimped fitting. The distance between the spring on one side and the split collar on the other side was controlled to allow for 4 mm of actuation of the spring once mounted into the pumphead housing. Mounting the tube in the pumphead involved using the blocks described in FIG. 3. The blocks were mounted onto a Watson Marlow 704S pump with bolts and the tubing element was snapped into place in the complimentary angled recesses.

The Watson Marlow 704 pump was operated at a speed of 250 rpm for 900 hours to obtain 54 million compressions until failure. The tubing moved approximately 5 mm in the axial direction during each compression as the pump operated. The tubing remained in the center of the pumphead and did not become entangled in the gears.

Example 3

Another PTFE lined peristaltic pump tube (Part Number SST-12-D), with an inside diameter of 19 mm and a wall thickness of 4.8 mm, was fitted with barb fittings. A piece of silicone tubing with an inside diameter of 28 mm, a length of 15 mm, and a thickness of 5 mm was placed around the outside diameter of the pump tubing on the discharge side of the pump. Split collars were placed around the outside diameter of the pump tubing in order to apply axial load to the unconstrained silicone compliant material and to fit into the complimentary angled recess of the receiving block described in Example 2 The soft silicone ring allowed for axial movement of the pump tubing during operation.

The Watson Marlow 704 pump was operated at a speed of 250 rpm for 1,080 hours to obtain 65 million compressions until failure. The tubing moved approximately 3 mm in the axial direction during each compression as the pump operated. The tubing remained in the center of the pumphead and did not become entangled in the gears.

Example 4

A silicone-PTFE composite tube was obtained from W.L. Gore & Associates, Inc. (STA-PURE™ Tubing, Part Number GD24M) and was equipped with crimped fittings and polyethylene collars as described in Example 1. The tubing assembly was mounted in the spring loaded block assembly. The Watson-Marlow model 704S pump was operated at a speed of 180 rpm for 4 days without any lateral movement of the tubing from the center of the track. The tube moved approximately 3 mm in the axial direction during pumping. The tube was removed from service with no significant deterioration in appearance.

Example 5

Thermoplastic elastomer tubing was obtained from Watson-Marlow, Inc. (Marprene™ Tubing, Part Number 902.0254.048) and was fitted with molded on polypropylene collars onto the outside of the tubing. The tubing assembly was mounted in the same spring loaded block assembly described in Example 1. The Watson-Marlow model 704S pump was operated at a speed of 360 rpm for 4 days without any lateral movement of the tubing from the center of the track. The tube moved approximately 3 mm in the axial direction during pumping. The tube was removed from service with no significant deterioration in appearance.

The invention claimed is:

1. A peristaltic pump comprising:

a pumphead having a separate suction side and discharge side;

a rotor rotatably mounted to the pumphead;

a first mounting block adjustably attached to the suction side of the pumphead and a second mounting block attached to the discharge side of the pumphead, each of the first and second mounting blocks having a recess therein for receiving a collar, each of the first and second mounting blocks being free from connection from the other of the first and second mounting blocks, and each of the first and second mounting blocks being moveable independently from the other of the first and second mounting blocks and the pumphead;

a flexible tube comprising:

a first end having a first collar affixed thereto, the first end secured to the first mounting block attached to the suction side of the pump head with the first collar at least partially located within the recess of the first mounting block; and a first end having a second collar affixed thereto, the second end secured to the second mounting block attached to the discharge side of the pump head with the second collar at least partially located within the recess of the second mounting block; and at least one compliant member positioned between each of the first and second mounting blocks and the suction side and discharge side of the pumphead respectively, thereby enabling the flexible tube and the first and second mounting blocks to move axially independently from one another with respect to the suction side and the discharge side of the pumphead and dynamically transfer tension-induced stress during pumping from the flexible tube to the at least one compliant members positioned between each of the first and second mounting blocks and the suction side of and the discharge side of pumphead respectively.

2. The peristaltic pump of claim 1, wherein each of the at least one compliant member positioned between each of the first and second mounting blocks and the suction side and discharge side of the pump respectively, comprises a spring.

3. The peristaltic pump of claim 2, wherein the springs have a spring constant of from about 1.7 Kg/mm to about 2.0 Kg/mm.

4. The peristaltic pump of claim 2, wherein the mounting blocks are attached to the pumphead with shoulder bolts.

5. The peristaltic pump of claim 1, wherein the at least one compliant member positioned between the first mounting block and the suction side and the at least one compliant member positioned between the second mounting block and discharge side of the pump respectively, comprises a spring to move from about 3 mm to about 10 mm during pumping.

6. The peristaltic pump of claim 1 further comprising crimped fittings on the first and second ends of the flexible tube.

7. A method of peristaltic pumping comprising:

(a) mounting a flexible tube having a first end and a second end, each end having a collar affixed thereto, in a peristaltic pump head comprising:

(i) a housing;

(ii) a plurality of mounting blocks free from connection to each other and adjustably attached to the pump head, each mounting block having a recess therein for receiving a collar; and (iii) at least one compliant member positioned between each mounting block and the pumphead to enable movement of the flexible tube in an axial direction so that tension-induced stress on the flexible tube is dynamically transferred to the at least one compliant members respectively positioned between each of the mounting blocks and pumphead during pumping;

(b) attaching the flexible tube to the mounting blocks by securing the collars at least partially within the recesses in the plurality of mounting blocks; and (c) compressing the flexible tube to convey a fluid therethrough.

8. A peristaltic pump comprising:

a pumphead having a separate suction side and discharge side;

a rotor rotatably mounted to the pumphead;

a plurality of rollers mounted to the rotor;

a flexible tube attached to the pumphead, the flexible tube having a first end and a second end;

first and second collars respectively located on the first and second ends of the flexible tube;

the first collar attached to the first end of the flexible tube and being mounted at least partially within a recess for receiving the collar in a first receiving plate moveably connected to the suction side of the pumphead;

the second collar attached to the second end of the flexible tube and being mounted at least partially within a recess for receiving the collar in a second receiving plate moveably connected to the discharge side of the pumphead, wherein the second receiving plate is free from connection to the first receiving plate; and a plurality of compliant members located between the first and second receiving plates and the separate suction and discharge sides of the pumphead to enable movement of the first and second receiving plates with respect to the pumphead and axial movement of the flexible tube therewith to reduce effects of compression and restitution on the flexible tubing during pumping.

9. The peristaltic pump of claim 8 further comprising crimped fittings on the first and second ends of the flexible tube.

10. The peristaltic pump of claim 8 wherein the plurality of compliant members comprise springs.

11. The peristaltic pump of claim 10 wherein the springs have a spring constant of from about 1.7 Kg/mm to about 2.0 Kg/mm.

12. The peristaltic pump of claim 8 wherein the first and second receiving plates move from about 3 mm to about 10 mm during pumping.

13. The peristaltic pump of claim 8 wherein the flexible tubing is continuous tubing.

* * * * *